US009283565B2

(12) United States Patent
Greenwood

(10) Patent No.: US 9,283,565 B2
(45) Date of Patent: Mar. 15, 2016

(54) SOIL CLASSIFIER

(71) Applicant: Shawn Patrick Greenwood, Telluride, CO (US)

(72) Inventor: Shawn Patrick Greenwood, Telluride, CO (US)

( * ) Notice: Subject to any disclaimer, the term of this patent is extended or adjusted under 35 U.S.C. 154(b) by 9 days.

(21) Appl. No.: 14/174,912

(22) Filed: Feb. 7, 2014

(65) Prior Publication Data

US 2014/0224357 A1 Aug. 14, 2014

Related U.S. Application Data

(60) Provisional application No. 61/763,809, filed on Feb. 12, 2013.

(51) Int. Cl.

| | |
|---|---|
| ***B03B 5/32*** | (2006.01) |
| ***B02C 17/16*** | (2006.01) |
| ***B02C 17/18*** | (2006.01) |

(52) U.S. Cl.

CPC ..... *B02C 17/168* (2013.01); *B02C 17/181* (2013.01); *Y10T 137/794* (2015.04)

(58) Field of Classification Search

CPC ..... B01F 7/00; B02C 17/168; B02C 17/181
USPC ..... 209/725, 208
See application file for complete search history.

(56) References Cited

U.S. PATENT DOCUMENTS

| | | | | | |
|---|---|---|---|---|---|
| 3,698,647 | A | * | 10/1972 | Nye | B02C 17/16 241/24.1 |
| 4,570,863 | A | * | 2/1986 | Knox, Jr. | B02C 23/36 241/33 |
| 4,813,617 | A | * | 3/1989 | Knox, Jr. | B02C 23/36 241/33 |
| 5,227,136 | A | * | 7/1993 | Hanify | B01F 3/04269 422/225 |

* cited by examiner

*Primary Examiner* — Terrell Matthews
(74) *Attorney, Agent, or Firm* — Peter R. Kramer

(57) ABSTRACT

A lightweight soil classifier consisting of a singular motor, a fully articulated flexible Vierendeel frame motor mount platform and conical basket lid weldment for the self-aligning and centering of a rotating shaft through a cylindrical screened classifier basket containing classified media, with an impervious conical bottom and a cylindrical bearing post incorporating a conduit, a classifier drive shaft with a semi-rigid coupling to the motor and a pumping screw extending through the bearing post conduit and submerged bearing surfaces to develop fluid dynamic bearing films of fine soils and liquid vehicle, fitted with an inverted cup-shaped classifier head consisting of outwardly projecting spirally arrayed classifier pins located within the confines of the classifier basket. Along with a rotating blade fastened to the tip of the classifier shaft below the basket bottom, the soil classifier is self-supported on feet within and on the floor of a vessel enabling a process for the deconglomeration, dispersion, particle size reduction and classification of soils all to within a common size.

41 Claims, 9 Drawing Sheets

SOIL CLASSIFIER

BACKGROUND OF THE INVENTION

1. Field of the Invention

This invention relates to a self-supporting dispersing apparatus that can be used as a soil classifier and for other applications requiring particle size reduction of solids. The apparatus is economically constructed, light weight and able to be lifted by hand into or out of a vessel, and more particularly relates to an improved form of similarly purposed machines by simplifying and reducing the number of mechanical components and weight by applying a combination of fluid dynamic bearing films supported by submerged bearing surfaces, a self-centering pumping screw housed in a conduit and a fully articulated motor platform.

2. Background

Similarly purposed machines such as basket and/or grinding mills are used for the deconglomeration and particle size reduction of solids within a liquid vehicle facilitating the use of a grinding media agitated by the use of high speed rotating blades, shafts, bearings, bearing housings, pulleys, belts, motors and rigid structural supports. These machines are generally supported outside of a vessel or affixed to the top edge of a vessel. Complex drive mechanisms are often supported by heavy bearing housing assemblies and without the advantages of fairly robust motor frames. High speed rotating shafts are designed either with or without a shaft end support. Without an end support, the shaft diameter and bearings must be large enough to prevent a catastrophic bending failure. An advantage of an end support is the ability to use smaller diameter shafts and bearings. The end support is typically a bushing or sealed bearing submerged in the process. The disadvantage of a submerged bushing or sealed bearing is the continuous maintenance concerns of wearing parts and the potential of process contamination due to wear surface material attrition.

Similar machines without the use of submerged bearings such as Araki's U.S. Pat. Nos. 5,447,372 and 7,275,704; Inoue's U.S. Pat. Nos. 6,029,915 and 6,325,310; and Ishikawa's U.S. Pat. No. 5,346,147 include the use of drive mechanisms that are well engineered to withstand excessive shaft deflections and are suitable for a wide variety of processes with minimal concern of solid accumulations in or around mechanical components that could be detrimental to the finished product.

A bushing or bearing near the end of a high speed rotating shaft is effective in reducing critical shaft deflections and as a result reduction of shaft diameters, bearing sizes and related drive components. Submerged bushings and/or bearings are found in several other similarly purposed machines such as Getzmann's U.S. Pat. No. 6,565,024; Hockmeyer's U.S. Pat. Nos. 5,184,783 through 7,883,036; Schieweg's U.S. Pat. No. 7,641,137; and D'Errico's U.S. Pat. No. 8,047,459. These machines are also referenced to illustrate the similar use of basket milling technology with emphasis on the downward direction of the process flow through the screened bottom of a cylindrical basket.

Some of the referenced patents include pumping screws and/or propellers either affixed to or part of a shaft for pumping process fluid downward through their respective assemblies. Where a bushing is used to stabilize a shaft, grinding media often escapes the basket which can be detrimental to the process and related mechanical components.

Although combinations of pumping screws and/or propellers plus the use of submerged bearings or bushings are used throughout the wet grinding basket milling industry as indicated above, intentionally pumping process components and liquid through main bearings for further deconglomeration and particle size reduction of solids within a liquid vehicle is not evident in similarly purposed machines.

The present invention includes the intentional pumping and particle size reduction of process components and liquid vehicle through submerged bearing surfaces forming fluid dynamic bearing films as the main radial and axial bearing supports of a classifier shaft assembly fitted to a fully articulated motor mounting platform providing multiple degrees of freedom. As a result, the drive system can be reduced in complexity, weight and cost.

All patents, patent applications, provisional patent applications and publications referred to or cited herein, are incorporated by reference in their entirety to the extent they are not inconsistent with the explicit teachings of the specification.

| | | | |
|---|---|---|---|
| 8,047,459 | November 2011 | D'Errico | 241/21 |
| 7,641,137 | January 2010 | Schieweg | 241/172 |
| 7,559,493 | April 2009 | Hockmeyer et al. | 241/21 |
| 7,275,704 | October 2007 | Araki | 241/172 |
| 7,175,118 | February 2007 | Hockmeyer | 241/172 |
| 6,565,024 | May 2003 | Getzmann et al. | 241/171 |
| 6,325,310 | December 2001 | Inoue | 241/46.01 |
| 6,029,915 | February 2000 | Inoue | 241/17 |
| 5,820,040 | October 1998 | Hockmeyer et al. | 241/46.17 |
| 5,497,948 | March 1996 | Hockmeyer | 241/46.17 |
| 5,447,372 | September 1995 | Araki et al. | 366/299 |
| 5,346,147 | September 1994 | Ishikawa et al. | 241/172 |
| 5,360,273 | November 1994 | Buckmann | 384/99 |
| 5,184,783 | February 1993 | Hockmeyer et al. | 241/172 |
| 4,813,617 | March 1989 | Knox, Jr. et al. | 241/46.06 |
| 4,637,555 | January 1987 | Furuichi et al. | 241/46.02 |
| 4,570,863 | February 1986 | Knox, Jr. et al. | 241/33 |
| 4,302,147 | November 1981 | Cherubim | 415/92 |
| 4,096,057 | June 1978 | Porritt et al. | 208/11 LE |
| 2,590,761 | March 1952 | R. F. Edgar | |
| 1,951,684 | March 1934 | Wells, H. D. | |
| 1,113,716 | October 1914 | Nikola Tesla | |

SUMMARY OF THE INVENTION

The present invention reduces the complexity of similarly purposed machines. This invention includes the intentional pumping and particle size reduction of process components and liquid vehicle through a gap between opposing bearing surfaces. The surfaces develop a fluid dynamic bearing film as the radial bearing support of a shaft assembly. The shaft assembly has an integral self aligning pumping screw housed within a bearing post conduit. The bearing post conduit is secured to the bottom center of a reversible cylindrical wire formed basket assembly which optionally may contain grinding or classified media. Flow of process components continues through the conduit and passes through an interstitial space formed between a thrust bearing and a bearing surface where a second fluid dynamic bearing film develops to support axial shaft loads. A constant-forced compression clamping mechanism is used to secure a bushing or bearing of sorts to the drive shaft which eliminates destructive tensile stresses within the bearing material during high speed rotations. The drive shaft assembly includes an integral hub with profiled spokes and a thin-walled rotating cylindrical body with an array of outwardly projecting pins used to agitate dispersing media. The profiled spokes recirculate dispersing media around the wall of the cylindrical body which provides for a more even and efficient distribution of dispersing media on the vertical walls of the basket. The drive shaft is semi-rigidly coupled to a motor that is mounted to a fully articulated platform with multiple degrees of freedom which further reduces the complexity, weight and the inherent cost of construction with the ensuing benefit of producing a portable machine which is self-supporting within a vessel that may be used to classify soils to all the same size or for dispersion and particle size reduction of other particulate solids.

It is understood that the foregoing examples are merely illustrative of the present invention. Certain modifications of the articles and/or methods employed may be made and still achieve the objectives of the invention. Such modifications are contemplated as within the scope of the claimed invention.

A DETAILED DESCRIPTION OF THE INVENTION

Figure 1:
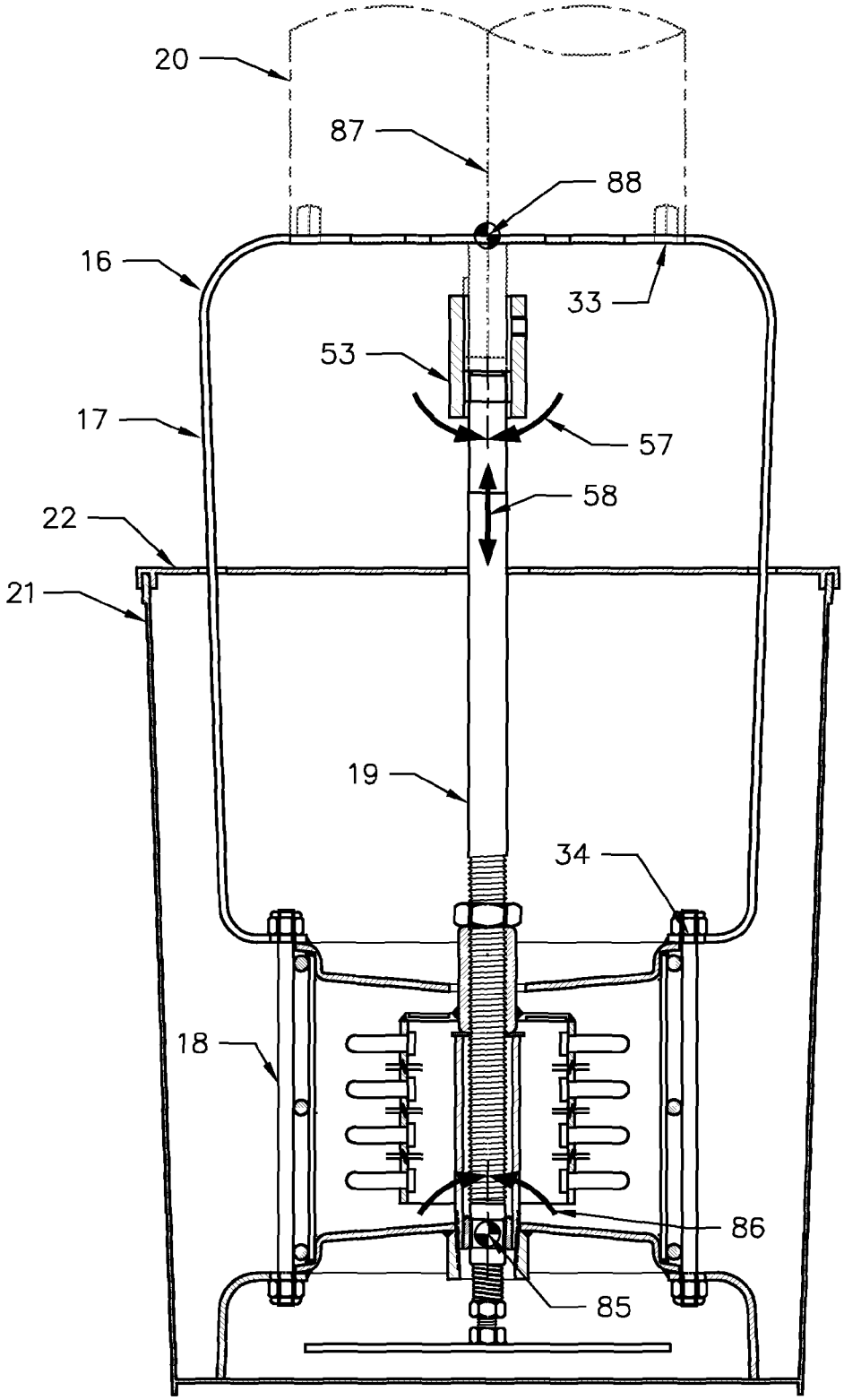
FIG. 1 is a cross section view of a dispersing apparatus for continuous processing of particulate material which is constructed in accordance with an embodiment of this invention.

In the following detailed description and the drawings, like reference characters indicate like parts.

FIG. 1 illustrates a dispersing apparatus 16 that can be used as a soil constructed in accordance with an embodiment of this invention. The dispersing apparatus 16 includes a motor mount weldment 17 (FIG. 2); a basket assembly 18 (FIG. 3); a shaft assembly 19 (FIG. 4); a motor 20; all of which is self supporting within and on the floor of vessel 21 and covered with a lid 22. The vessel 21 (FIG. 1) with the lid 22 in this invention is a covered pail which may also serve as a storage container for the dispersing apparatus 16.

Figure 2:
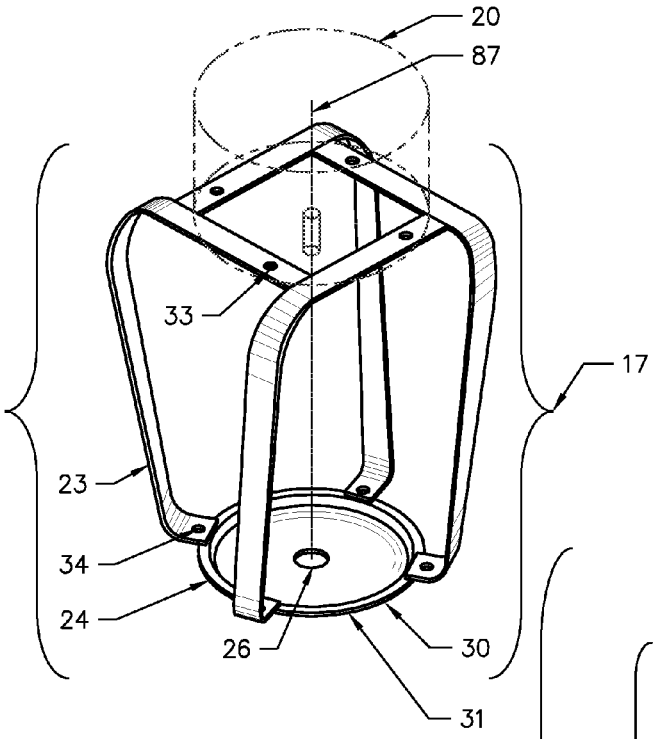
FIG. 2 is an exploded isometric view of the motor mount weldment.
Figure 10:
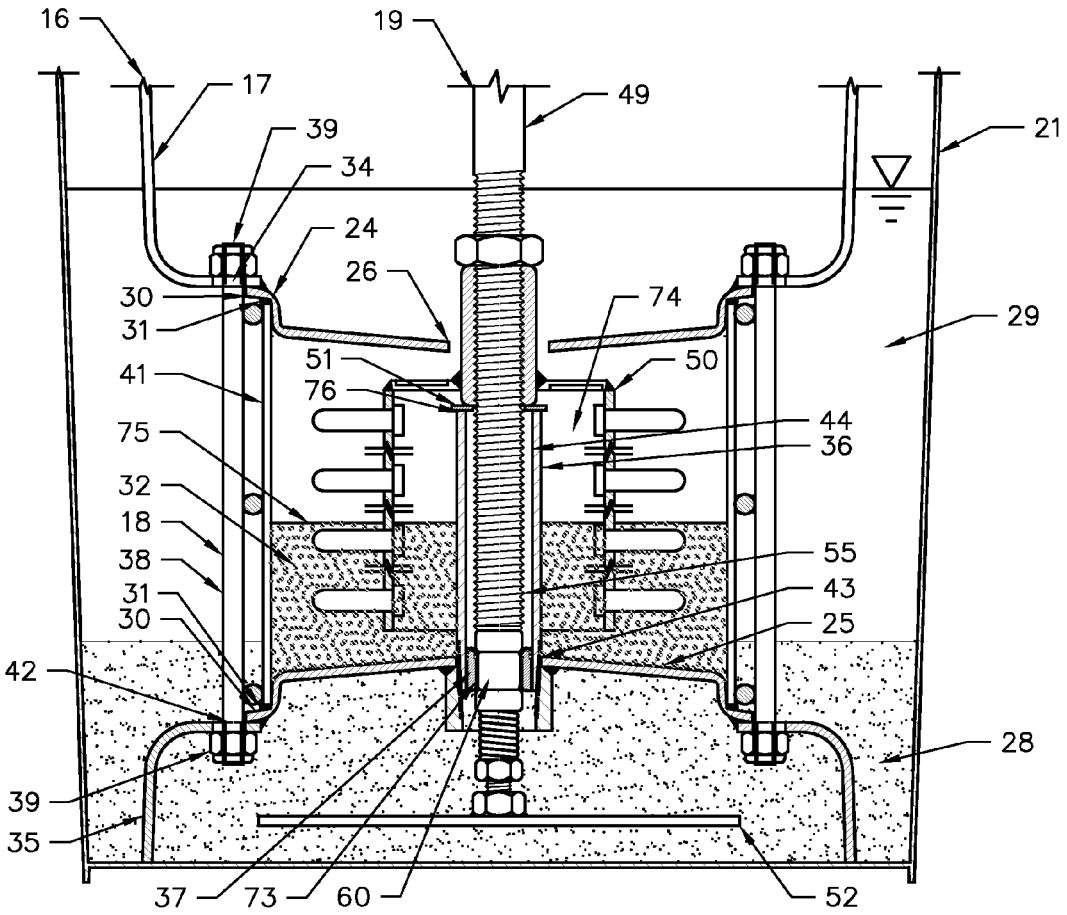
FIG. 10 is a partial cross section view of this invention charged with classified media, soils to be classified and a liquid vehicle.
Figure 11:
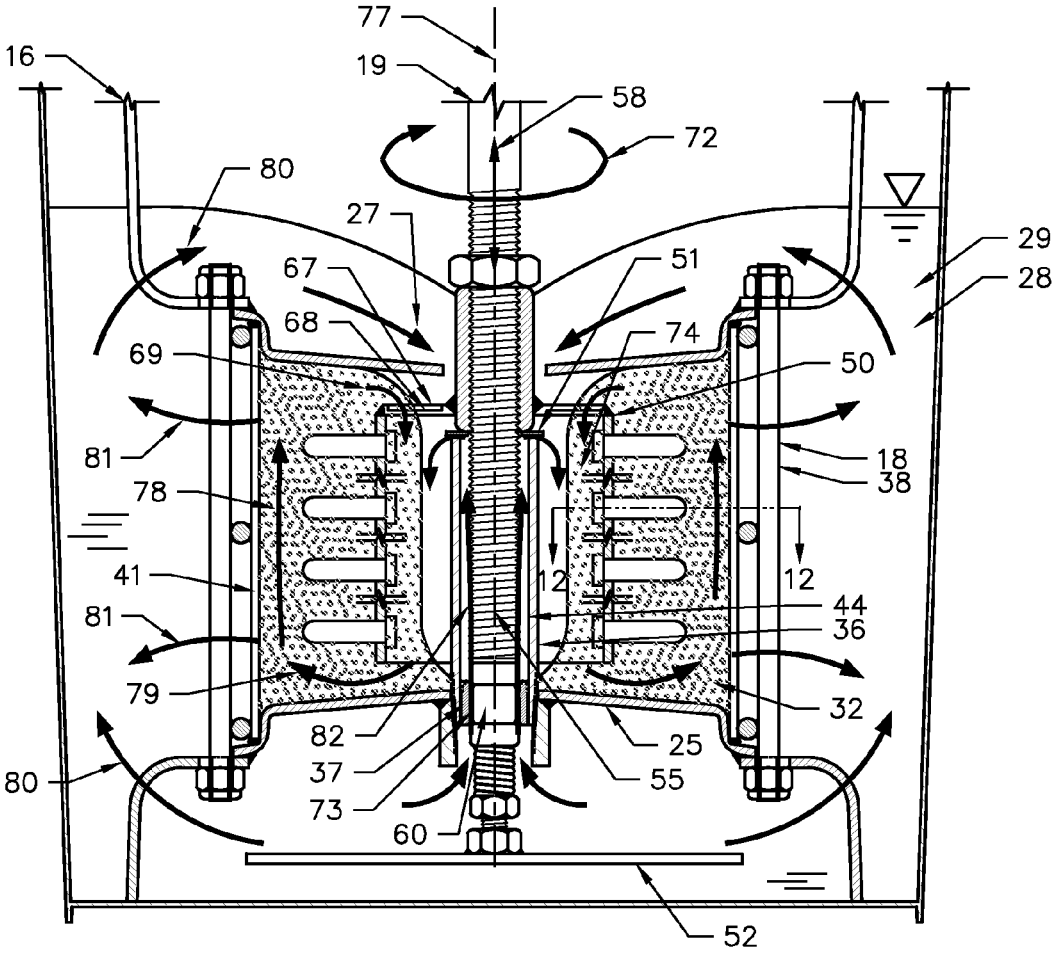
FIG. 11 is a cross section view of this invention in the process of classifying soils.
Figure 12:
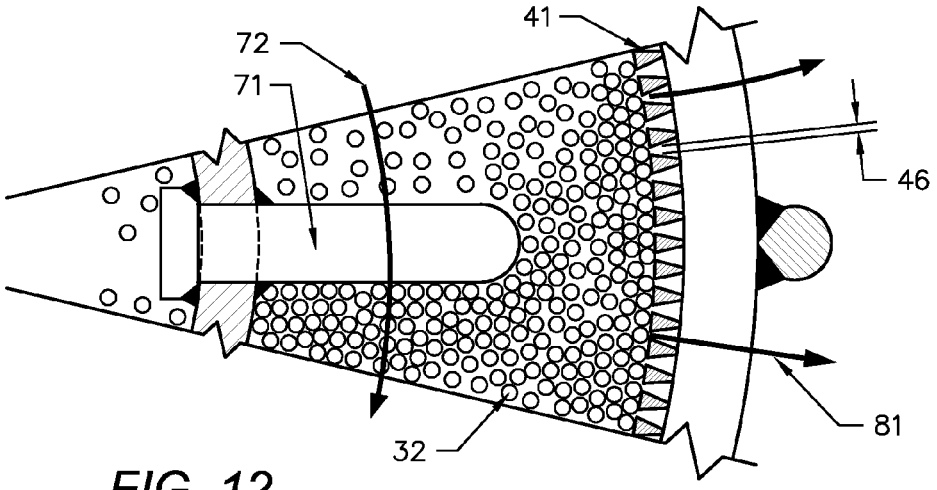
FIG. 12 is a partial section view taken on line 12-12 of FIG. 11.

FIG. 2 illustrates the motor mount weldment 17 consisting of multiple bars 23 bent to a shape to match the mounting surface of a motor 20 and extended to the basket lid 24 collectively forming a singular fully articulated Vierendeel frame. The basket lid 24 is formed to a shape matching that of the basket bottom 25 (FIG. 3), inverted to provide a funnel shaped entrance to the basket inlet 26, sized accordingly for the flow through the basket inlet 27 of soils 28 and liquid vehicle 29 (see FIG. 11), and a recessed lip 30 to protect and preserve a basket gasket 31 from the abrasive action of grinding or classified media 32 (FIGS. 10, 11, and 12). The bars 23 include motor fastener holes 33 and basket assembly fastener holes 34 for securing the motor 20 and the basket assembly 18 respectively (FIG. 1). The basket gasket 31 functions as a seal to contain grinding or classified media 32 within the basket assembly 18 (see FIG. 10).

Figure 3:
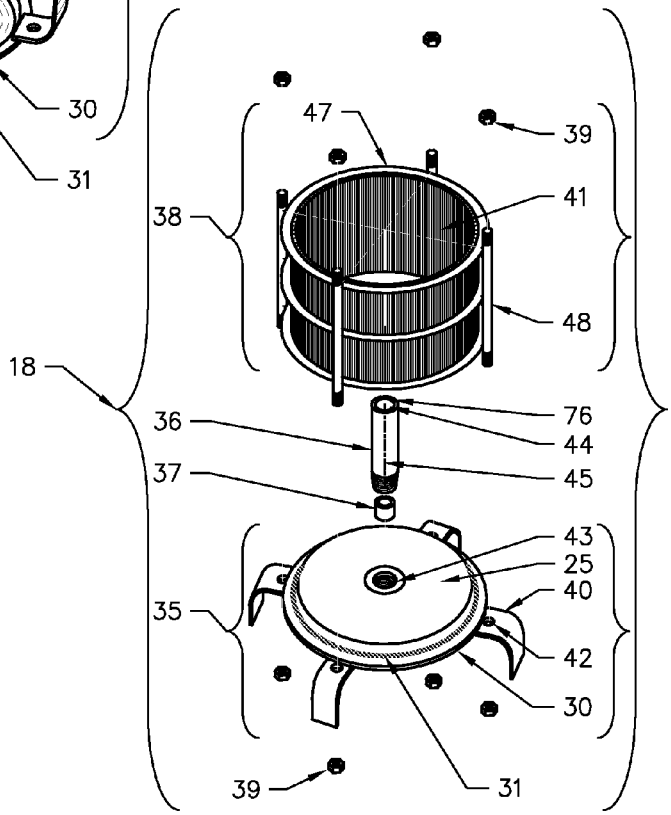
FIG. 3 is an exploded isometric view of the basket assembly.

FIG. 3 illustrates the basket assembly 18 consisting of a basket bottom weldment 35; a bearing post 36 and a fixed radial bearing 37; a screen weldment 38 and basket fasteners 39. The basket bottom weldment 35 consists of an impervious basket bottom 25 with the same profile as the basket lid 24 (FIG. 2). Multiple bars bent to form basket feet 40 are welded to the basket bottom 25 to form the basket bottom weldment 35. The basket bottom 25 is sloped (see FIGS. 10 and 11) towards its perimeter coinciding with the inside of the longitudinal screen wires 41. Basket feet fastener holes 42 are used to secure the screen weldment 38 with basket fasteners 39 while encapsulating the basket gasket 31 within the recessed lip 30. The fixed radial bearing 37 is positioned inside the bearing post 36. The bearing post 36 is secured to the threaded center of the basket bottom 43. The bearing post 36 maintains a conduit 44 (see exaggerated view in FIG. 13) and the conduit centerline 45. The screen weldment 38 consists of trapezoidal shaped longitudinal screen wires 41 with a screen gap 46 to contain grinding or classified media 32 (see FIG. 12). Circumferential rods 47 wrap around the longitudinal screen wires 41 and are supported by longitudinal rods 48 which are used to fasten the classifier screen weldment 38 to the basket assembly fastener holes 34 and the basket feet fastener holes 42 located in the motor mount weldment 17 and the basket bottom weldment 35 respectively using basket fasteners 39 (see FIG. 10). In the preferred embodiment, the screen weldment 38 is designed as a Vierendeel frame capable of sustaining torsional loads transferred from the shaft assembly 19 (FIG. 4) to the basket assembly 18 (see FIGS. 10 and 11).

Figure 4:
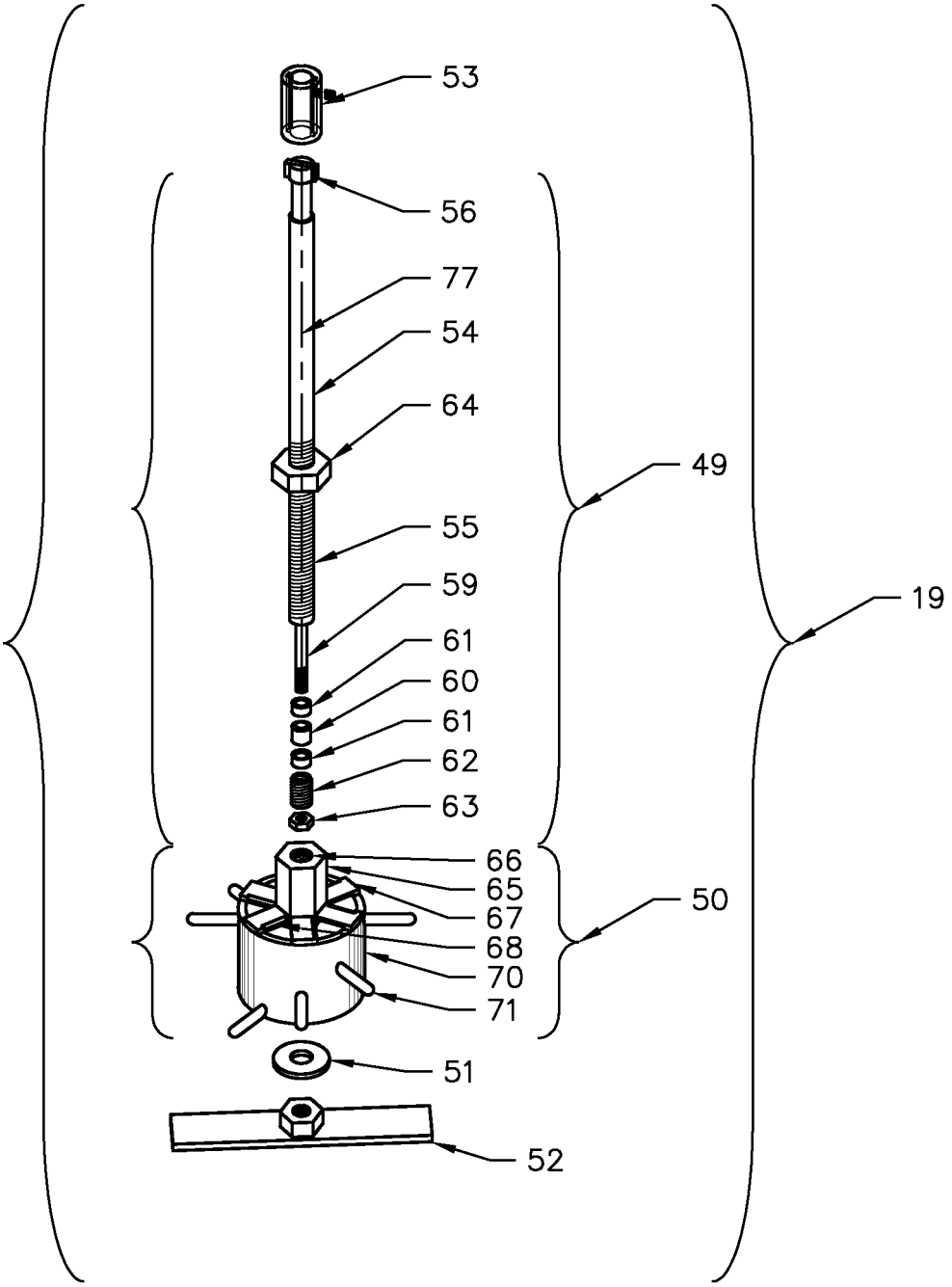
FIG. 4 is an exploded view of the shaft assembly.
Figure 5:
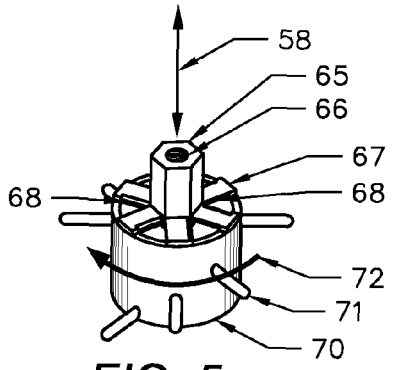
FIG. 5 is an isometric view of a head weldment which is constructed in accordance with an embodiment of this invention.
Figure 6:
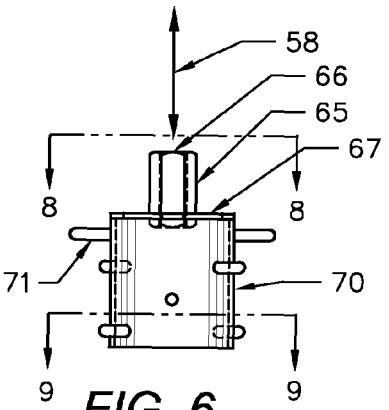
FIG. 6 is a side view of the head weldment.
Figure 7:
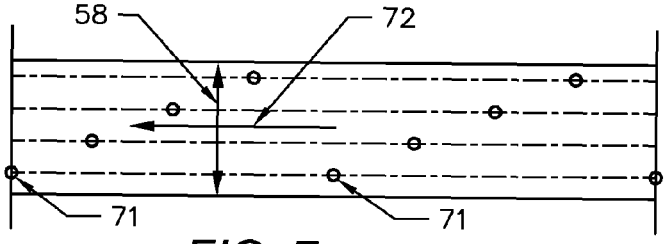
FIG. 7 is a view of the spacing of outwardly projecting pins as situated around the perimeter of a head weldment which is constructed in accordance with an embodiment of this invention.
Figure 8:
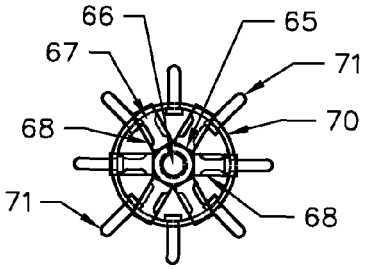
FIG. 8 is a top view of the head weldment taken on the line 8-8 in FIG. 6.
Figure 9:
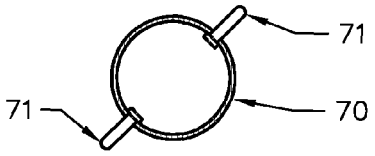
FIG. 9 is a section view taken on line 9-9 in FIG. 6.
Figure 13:
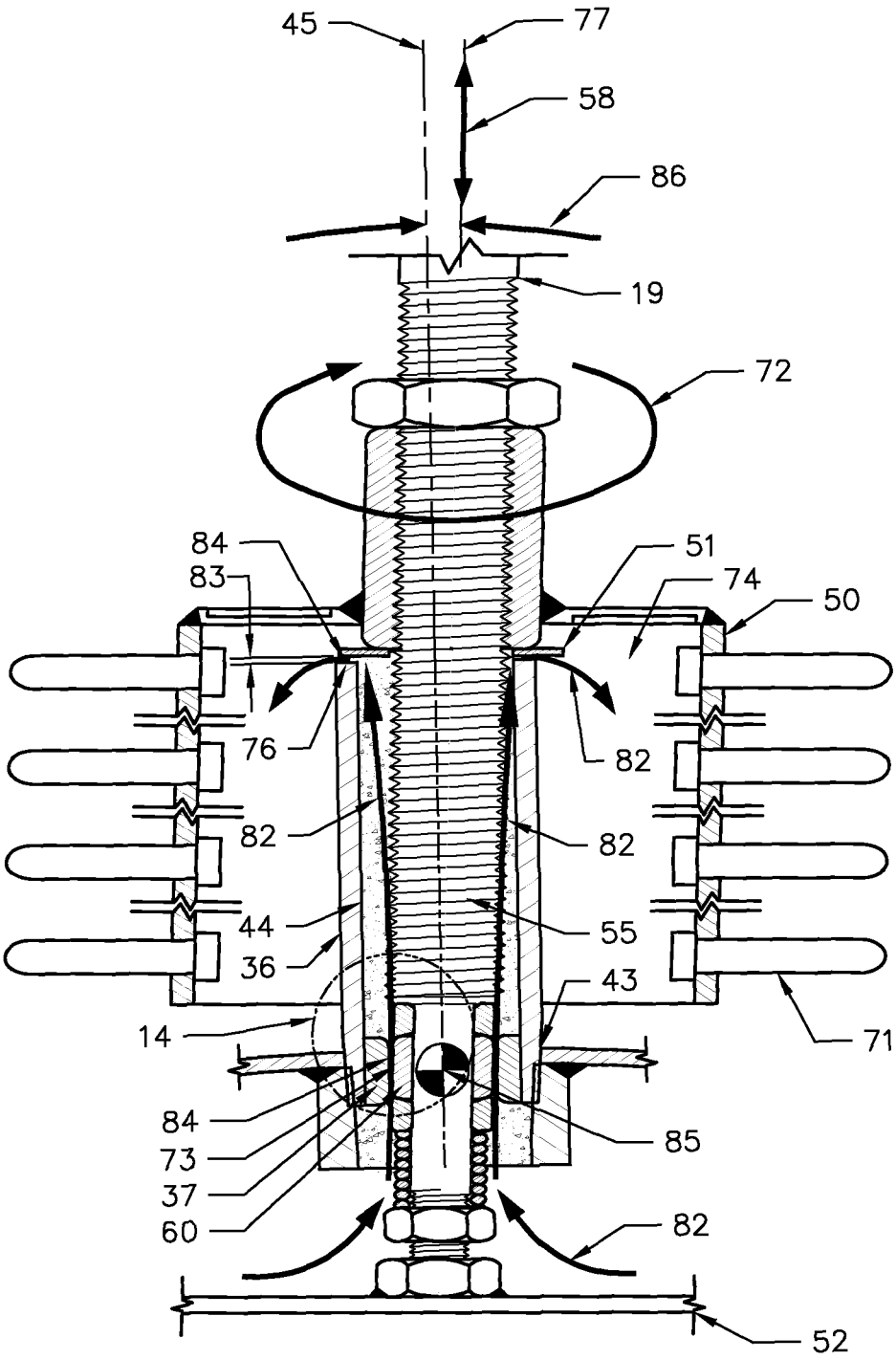
FIG. 13 is an illustration of the pumping screw with an exaggerated cross section of the conduit within the bearing post.
Figure 14:
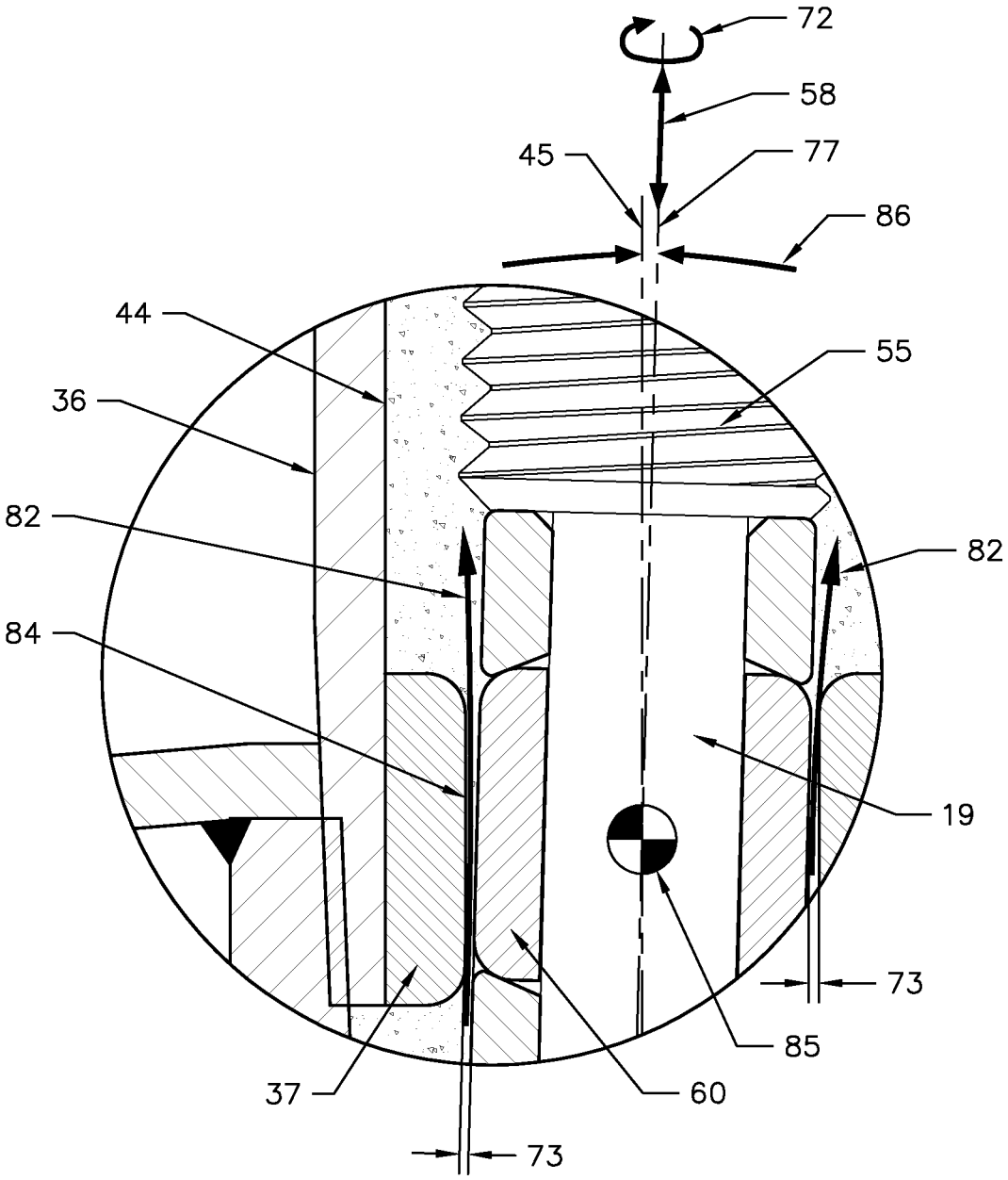
FIG. 14 is a cross-section illustrating a fluid dynamic bearing film taken from view 14 of FIG. 13.
Figure 15:
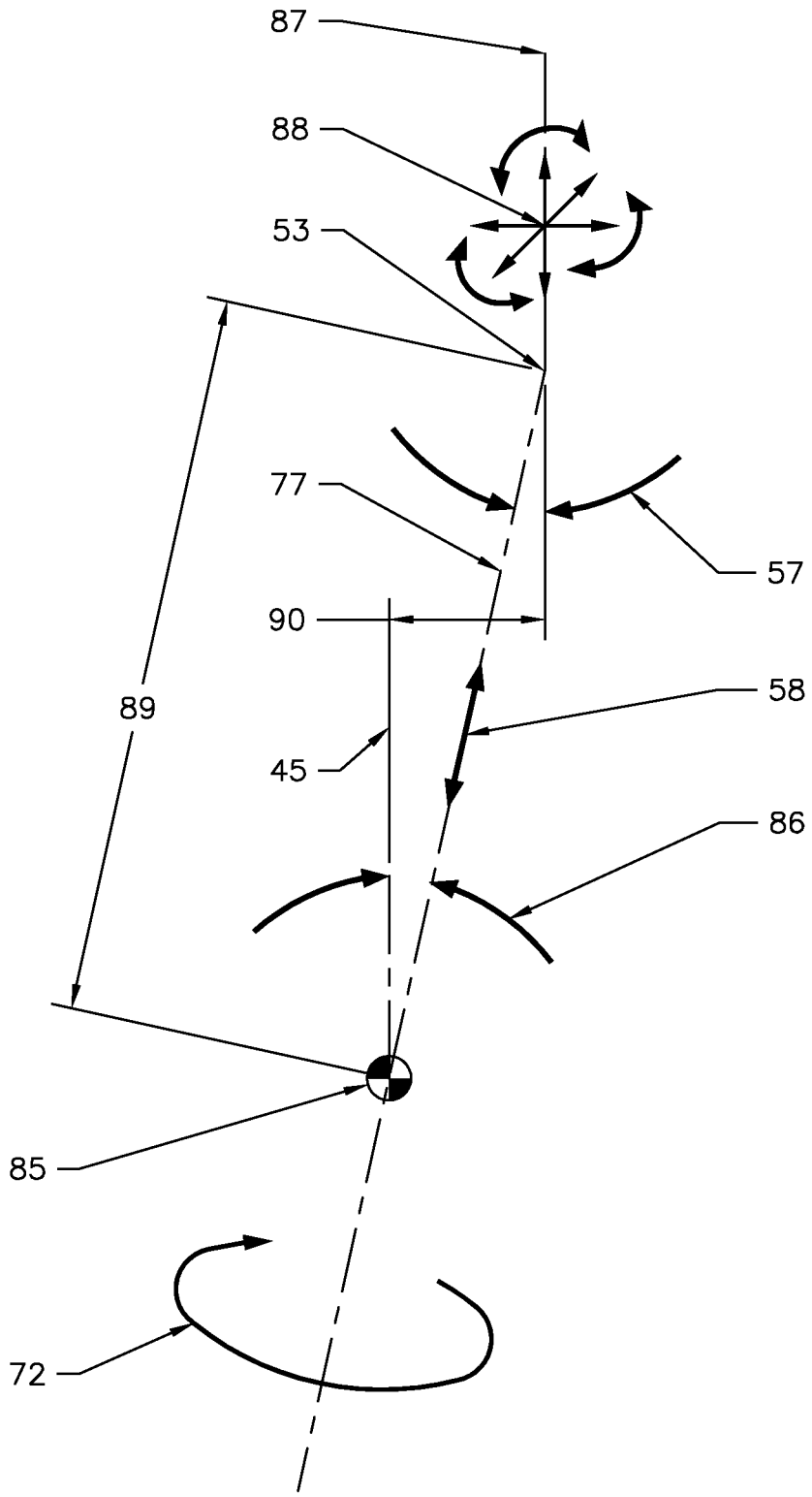
FIG. 15 illustrates the multiple degrees of freedom, an embodiment of this invention.

FIG. 4 illustrates the shaft assembly 19 consisting of a shaft assembly 49; a head weldment 50; a thrust bearing 51; a blade 52 and a motor shaft coupling 53. The shaft assembly 49 consists of a shaft 54 with an integral pumping screw 55. The drive end 56 of the shaft 54 is keyed to match the motor shaft coupling 53 to allow for shaft angle fluctuations 57 and shaft axial displacements 58 (see FIGS. 1, 11, 13, 14 and 15) of the shaft 54. Also integral to the shaft 54 is a reduced shaft section 59 sized to affix a rotating radial bearing 60 secured with two bearing clamps 61, a compression spring 62 to maintain a constant compressive force on the bearing clamps 61 and rotating radial bearing 60 and a bearing nut 63, all sized to fit within the minor diameter of the pumping screw 55 thread form, a preferred embodiment of this invention. An adjustable nut 64 is used to position and secure the head weldment 50 along the length of the pumping screw 55 in order for the rotating radial bearing 60 to align with the fixed radial bearing 37 (see FIGS. 10, 11, 13 and 14). The head weldment 50, as further illustrated in FIGS. 5, 6, 7, 8 and 9, consists of an integral hub 65 with a threaded center 66 to match the thread form of the pumping screw 55, spokes 67 with profiled leading edges 68 for the recirculation of grinding or classified media 69 (FIG. 11) around an inverted thin walled cylinder 70 supporting a multitude of outwardly projecting pins 71 in a spiral array as illustrated in FIGS. 5, 6 and 7 to resemble a screw for which to hydrostatically force the head weldment 50 against the thrust bearing 51 during the rotation 72 (see also FIGS. 5, 7, 11, 13, 14 and 15) of the shaft assembly 19. The pumping screw 55 extends down through the conduit 44 of the bearing post 36 (see also FIGS. 10, 11, 13 and 14). The rotating radial bearing 60 clamped to the reduced shaft section 59 fits inside the fixed radial bearing 37 (see also FIGS. 10, 11, 13 and 14). The radial clearance between the inside diameter of the fixed radial bearing 37 and the outside diameter of the rotating radial bearing 60 is the radial bearing gap 73 (FIGS. 10, 11, 13 and 14). The tip of the reduced shaft section 59 is fitted with a blade 52 (FIGS. 10, 11 and 13). The profile of the blade 52 can be selected based on the type of particulate solids or soil conditions and process parameters. The motor shaft coupling 53 (FIGS. 1 and 4) is rigidly fastened to the output shaft of the motor 20 (FIG. 1). The opposite end of the coupling 53 fits loosely to the drive end 56 of the drive shaft 54 to allow for shaft angle fluctuations 57 and shaft axial displacements 58 (FIGS. 1 and 15).

FIG. 10 partially illustrates an assembled dispersing apparatus 16 in a vessel 21. The pumping screw 55 is inserted through the thrust bearing 51 and the conduit 44 (see FIG. 13 for exaggerated view) in the bearing post 36 which is secured to the threaded center of the basket bottom 43. Classified media 32 may be added, if needed, to the inside of the basket assembly 18 and in the media reservoir 74 within the head weldment 50, to a media fill level 75 appropriate for the process conditions and below the fixed axial bearing 76 end of the bearing post 36 (see also FIG. 3). The shaft assembly 49 is inserted up through the basket inlet 26 of the motor mount weldment 17. FIG. 10 further illustrates the assembly of the basket gasket 31 compressed within the recessed lip 30 and the screen weldment 38 and secured with the basket fasteners 39. The screen weldment 38 can be inverted as the longitudinal screen wires 41 erode to extend its useful life and is an embodiment of this invention. Liquid vehicle 29 and particulate solids 28 to be processed are added to the vessel 21 to a level above the basket lid 24.

FIG. 11 illustrates the dispersing apparatus 16 in operation as the drive assembly 19 rotates 72 about the shaft centerline 77. The rotation 72 (FIG. 5) of the head weldment 50 causes the ascension of media 78 within the screen weldment 38 while the slope of the basket bottom 25 assists in the centrifugal conveyance of grinding or classified media 79 from the media reservoir 74. The profiled leading edges 68 of the spokes 67 of the head weldment 50 are shaped to provide a recirculation of media 69 through the media reservoir 74 to better distribute media 32 along the inside surface of the longitudinal screen wires 41 of the screen weldment 38. The rotation 72 of a the blade 52 (FIG. 4) causes particulate solids 28 to be suspended throughout the liquid vehicle 29 in a turbulent flow 80 throughout the vessel 21. Flow through the basket inlet 27 is developed by centrifugal pumping forces produced by the rotation 72 (FIG. 5) of the head weldment 50 followed by the process flow 81 of suspended particulate solids 28 and liquid vehicle 29 out through the screen gaps 46 (see also FIG. 12). In addition to the work performed by the pumping screw 55, flow of particulate solids and liquid vehicle through the bearings 82 is produced by the aforementioned centrifugal forces, however is limited by the radial bearing gap 73 (FIGS. 13 and 14). The flow through the basket inlet 27 plus the flow of soils and liquid vehicle through the bearings 82 equals the total process flow 81 out through the screen gaps 46.

FIG. 12, a partial section view taken on line 12-12 of FIG. 11, illustrates the rotation 72 of the outwardly projecting pins 71 and process flow 81 out through the screen gaps 46 of the longitudinal screen wires 41. The screen gap 46 is approximately one half of the diameter of the grinding or classified media 32 to prevent the grinding or classified media 32 from exiting the screen 41.

FIG. 13 illustrates part of the shaft assembly 19 (FIG. 4), the thrust bearing 51, the bearing post 36, the fixed radial bearing 37 and the rotating radial bearing 60, all exaggerated in the radial direction to better illustrate the flow of soils and liquid vehicle through the bearings 82. During the rotation 72 of the shaft assembly 19, the flow of soils and liquid vehicle through the bearings 82 pumps through the radial bearing gap 73, along the length of the conduit 44, through the axial bearing gap 83 formed between the thrust bearing 51 and the fixed axial bearing 76, and then into the media reservoir 74. The flow of soils and liquid vehicle through the bearings 82 develop fluid dynamic bearing films 84 within the radial bearing gap 73 and the axial bearing gap 83. The direction of the flow of particulate solids or soils and liquid vehicle through the bearings 82 prevent grinding or classified media 32 from exiting the basket assembly 18 (FIG. 11) through the conduit 44. The fixed radial bearing 37, the rotating radial bearing 60, the conduit centerline 45 of and the shaft centerline 77 all coincide at a fulcrum point 85.

FIG. 14 further illustrates the formation of a fluid dynamic bearing film 84 during the flow of soils and liquid vehicle through the bearings 82 as limited by the radial bearing gap 73 sized to allow for bearing post angle fluctuations 86 and the shaft axial displacements 58 through the fulcrum point 85 during the rotation 72 of the shaft assembly 19.

FIG. 15 illustrates the multiple degrees of freedom of the stirring system, an embodiment of this invention. During the operation of the dispersing apparatus 16 (FIG. 11), the motor centerline 87 (see also FIGS. 1 and 2) is free to articulate about a motor platform point 88 relative to the fulcrum point 85 (see also FIG. 13) due to the flexible design of the Vierendeel frame motor mount weldment 17 (FIGS. 1 and 2). In addition to the fully articulated motor platform point 88, a motor shaft coupling 53 (FIGS. 1 and 4) allows for continuous shaft angle fluctuations 57 and shaft axial displacements 58 in order for the shaft centerline 77 of the drive shaft 54 (FIG. 4) to self-center through the fulcrum point 85 (see also FIGS. 1 and 13) within the conduit 44 (FIG. 13) of the bearing post 36 (FIG. 13) during rotation 72 of the drive assembly 19 (FIG. 4). The conduit 44 (FIG. 13) allows room for the continuous bearing post angle fluctuations 86 to the centerline 45 of the bearing post 36 and the shaft centerline 77 (FIGS. 1 and 13). Any dynamic shaft axial displacement 58 of the drive assembly 19 will correspondingly vary the pathway of the outwardly projecting pins 71 (see also FIGS. 5,6 and 7) through the grinding or classified media 32 (FIG. 11). Since the distance 89 and the offset 90 between the motor coupling 53 and the fulcrum point 85 are allowed to vary with multiple degrees of freedom, the need for machined parts with strict dimensional tolerances is obviated, thereby significantly reducing production costs.

Consequently, this invention is optimized for an effective application of fluid dynamic bearing films consisting of process components, pumped through the gaps of radial and axial bearings with the assistance of a pumping screw within a conduit and driven by a motor mounted on a fully articulated motor platform, all with the intent of providing a low cost, portable dispersing apparatus for the deconglomeration, dispersion, particle size reduction of particulate solids or classification of soils (or like materials) to the same size.

The expression "fully articulated" when applied to an object is defined to mean that the object can freely articulate. For example, "fully articulated motor platform" as used herein should convey that the motor centerline 87 is free to articulate about the motor platform point 88 relative to the fulcrum point 85 in accordance with multiple degrees of freedom as depicted in FIG. 15.

I claim:

1. An apparatus for deconglomeration and particle size reduction of solids in a liquid vehicle, such as for processing soils to be classified in a liquid vehicle, comprising, a motor mount weldment, a basket assembly, said basket assembly optionally containing classified media, a shaft assembly, a motor, said motor mount weldment further forming a flexible Vierendeel frame, said motor mount weldment further forming an integral basket lid, said integral basket lid having a funnel shaped concentric inlet and a basket gasket, said apparatus arranged to be self supporting when placed within a vessel.

2. The apparatus of claim 1, further comprising, a multiplicity of bent bars, said motor mount weldment having said multiplicity of bent bars and with said motor mount weldment having said multiplicity of bent bars configured to enable the motor centerline to fully articulate about the motor platform point in relation to said integral basket lid.

3. The apparatus of claim 1, further comprising, a recessed lip, aid integral basket lid having said recessed lip configured to protect and preserve said basket gasket.

4. The apparatus of claim 1, further comprising, an arrangement wherein said motor mount weldment supports the weight and dynamic loads of said motor.

5. An apparatus for deconglomeration and particle size reduction of solids in a liquid vehicle, such as for processing soils to be classified in a liquid vehicle, comprising, a motor mount weldment, said motor mount weldment further forming a Vierendeel frame, a basket assembly, said basket assembly optionally containing classified media, a shaft assembly, a motor, a basket bottom, a basket bottom weldment, a bearing post, a screen weldment, a basket gasket, one or more basket fasteners, said basket assembly comprising said basket bottom weldment, said bearing post, said screen weldment, said basket gasket, and said basket fasteners, and said apparatus arranged to be self supporting when placed within a vessel.

6. The apparatus of claim 5, further comprising, a multiplicity of basket feet, and said basket bottom weldment as self-supporting on said basket feet.

7. The apparatus of claim 5, further comprising, a recessed lip, said basket bottom weldment having said recessed lip configured to protect and preserve said basket gasket.

8. The apparatus of claim 5, further comprising, a threaded center in the basket bottom, said threaded center configured to receive said bearing post, thereby permitting said basket bottom to be affixed to said bearing post at the center of said basket bottom.

9. The apparatus of claim 5, further comprising, a coaxial fixed radial bearing, a conduit along a conduit centerline and a fixed axial bearing, said bearing post comprising said coaxial fixed radial bearing, said conduit along a conduit centerline and said fixed axial bearing.

10. The apparatus of claim 9, further comprising, a fulcrum point, said fulcrum point located at the midpoint of the centerline of said fixed radial bearing.

11. The apparatus of claim 9, further comprising, an arrangement wherein said fixed axial bearing is positioned above the level of the media fill level.

12. The apparatus of claim 5, further comprising, a multiplicity of integral longitudinal rods, said screen weldment having said multiple integral longitudinal rods configured to enable basket fasteners to be affixed thereto.

13. The apparatus of claim 5, further comprising, an arrangement wherein said basket gasket provides an elastomeric compression force to prevent loosening of said basket fasteners.

14. An apparatus for deconglomeration and particle size reduction of solids in a liquid vehicle, such as for processing soils to be classified in a liquid vehicle, comprising, said motor mount weldment said motor mount weldment further forming a Vierendeel frame, a basket assembly, said basket assembly optionally containing classified media, a shaft assembly, a motor, a motor shaft, a motor shaft coupling, a shaft assembly, a head weldment, a thrust bearing, a blade, said shaft assembly further comprised of said motor shaft coupling, said shaft assembly, said head weldment, and said apparatus arranged to be self supporting within a vessel.

15. The apparatus of claim 14, further comprised by, said motor shaft coupling being rigidly affixed to said shaft and said shaft assembly further configured to articulate angularly and axially in relation to the drive end of said shaft assembly for shaft angle fluctuations and shaft axial displacements while transmitting rotational forces to said shaft assembly.

16. The apparatus of claim 14, further comprising, an adjustable nut, a rotating radial bearing, one or more bearing clamps, a compression spring and a bearing nut, and said apparatus having said shaft, said adjustable nut, said rotating radial bearing, said one or more bearing clamps, said compression spring and a bearing nut as integral components of said shaft assembly.

17. The apparatus of claim 16, further comprising, a drive end, a pumping screw, and a reduced shaft section, all of which are integral components of said shaft assembly and which are in alignment with the shaft centerline.

18. The apparatus of claim 17, further comprising, said drive end of said shaft configured to articulate angularly and axially in relation to said motor shaft coupling for said shaft angle fluctuations and said shaft axial displacements and with means to transmit rotational forces.

19. The apparatus of claim 16, further comprising,
a reduced shaft section, and
further characterized by having said rotating radial bearing axially clamped between said bearing clamps while further having said compression spring and said bearing nut positioned to maintain an axial compression force on said rotating radial bearing thereby reducing tensile stresses within said rotating radial bearing material, all of which are affixed to said reduced shaft section.

20. The apparatus of claim 14, further comprising,
a hub,
said hub having a radial array of spokes,
said radial array of spokes supporting a coaxial thin walled cylinder,
said coaxial thin walled cylinder supporting an outwardly projecting array of pins.

21. The apparatus of claim 20, further comprising,
profiled leading edges, said profiled leading edges positioned on the spokes of said radial array of spokes,
said radial array of spokes with said profiled leading edges configured to induce a flow through said thin walled cylinder during the rotation of said shaft assembly.

22. The apparatus of claim 14, further comprising,
a rotating radial bearing,
a fixed radial bearing,
a radial bearing gap,
means to affix said head weldment along length of said shaft assembly thereby aligning said rotating radial bearing coaxially within said fixed radial bearing and thereby forming said radial bearing gap in between the outside diameter of said rotating radial bearing and inside diameter of said fixed radial bearing.

23. The apparatus of claim 1, further comprising,
a media reservoir within said thin walled cylinder of said head weldment configured to reduce starting torque loads of said motor.

24. An apparatus for deconglomeration and particle size reduction of solids in a liquid vehicle, such as for processing soils to be classified in a liquid vehicle, comprising,
said motor mount weldment said motor mount weldment further forming a Vierendeel frame,
a basket assembly, said basket assembly optionally containing classified media,
a shaft assembly,
a media reservoir,
a motor,
a screen weldment,
a plurality of profiled leading edges
a plurality of spokes, having said plurality of profiled leading edges,
said head weldment further comprising said plurality of spokes having said profiled leading edges configured to recirculate the classified media down through said media reservoir, resulting in the ascension of the classified media along the inside surface of said screen weldment during said rotation of said shaft assembly, and
said apparatus arranged to be self supporting when placed within a vessel.

25. An apparatus for deconglomeration and particle size reduction of solids in a liquid vehicle, such as for processing soils to be classified in a liquid vehicle, comprising,
said motor mount weldment said motor mount weldment further forming a Vierendeel frame,
a basket assembly, said basket assembly optionally containing classified media,
a shaft assembly,
a motor,
a thrust bearing,
a fixed axial bearing,
an axial bearing gap formed between said thrust bearing and said fixed axial bearing,
said thrust bearing and said axial bearing configured to transfer axial loads of said shaft assembly to said fixed axial bearing, and
said apparatus arranged to be self supporting when placed within a vessel.

26. An apparatus for deconglomeration and particle size reduction of solids in a liquid vehicle, such as for processing soils to be classified in a liquid vehicle, comprising,
said motor mount weldment said motor mount weldment further forming a Vierendeel frame,
a basket assembly, said basket assembly optionally containing classified media,
a shaft assembly,
a motor,
a reduced shaft section,
a basket bottom weldment, with said reduced shaft section protruding out through the bottom of said basket bottom weldment thereby providing turbulent flow of the liquid vehicle and the soils or the solids,
a blade, said blade fitted to the tip of said reduced shaft section, and
said apparatus arranged to be self supporting when placed within a vessel.

27. An apparatus for deconglomeration and particle size reduction of solids in a liquid vehicle, such as for processing soils to be classified in a liquid vehicle, comprising,
said motor mount weldment said motor mount weldment further forming a Vierendeel frame,
a basket assembly, said basket assembly optionally containing classified media,
a shaft assembly,
a motor,
one or more basket fasteners,
a basket gasket,
an integral basket lid, said integral basket lid having a recessed lip to protect and preserve said basket gasket,
means to affix said motor mount weldment with said one or more basket fasteners thereby compressing said basket gasket within said recessed lip, and
said apparatus arranged to be self supporting when placed within a vessel.

28. The apparatus of claim 1, further comprising,
an arrangement wherein said basket assembly is configured to support static and dynamic loads of said motor mount weldment and said motor on the floor of said vessel.

29. An apparatus for deconglomeration and particle size reduction of solids in a liquid vehicle, such as for processing soils to be classified in a liquid vehicle, comprising,
said motor mount weldment said motor mount weldment further forming a Vierendeel frame,
a basket assembly, said basket assembly optionally containing classified media,
a shaft assembly,
a motor,
a pumping screw,
a conduit,
a radial bearing gap,
an axial bearing gap,
a media reservoir,
said pumping screw mounted within said conduit thereby providing a mechanism to pump solids in a liquid vehicle up through said radial bearing gap, said conduit, said axial bearing gap and into said media reservoir, and said apparatus arranged to be self supporting when placed within a vessel.

30. The apparatus of claim 1, further comprising, a fulcrum point, said apparatus configured such that the shaft centerline self-aligns with said fulcrum point during said rotation of said shaft assembly.

31. An apparatus for deconglomeration and particle size reduction of solids in a liquid vehicle, such as for processing soils to be classified in a liquid vehicle, comprising, said motor mount weldment said motor mount weldment further forming a Vierendeel frame, a basket assembly, said basket assembly optionally containing classified media, a shaft assembly, a motor, said shaft assembly having means for axial shaft displacements in relation to the fulcrum point, said apparatus arranged to be self supporting when placed within a vessel.

32. An apparatus for deconglomeration and particle size reduction of solids in a liquid vehicle, such as for processing soils to be classified in a liquid vehicle, comprising, said motor mount weldment said motor mount weldment further forming a Vierendeel frame, a basket assembly, said basket assembly optionally containing classified media, a shaft assembly, a motor, means for bearing post angle fluctuations in relation to shaft centerline about the fulcrum point, and said apparatus arranged to be self supporting when placed within a vessel.

33. An apparatus for deconglomeration and particle size reduction of solids in a liquid vehicle, such as for processing soils to be classified in a liquid vehicle, comprising, said motor mount weldment said motor mount weldment further forming a Vierendeel frame, a basket assembly, said basket assembly optionally containing classified media, a shaft assembly, a motor, a fixed axial bearing, a thrust bearing, said thrust bearing having means to translate laterally across the surface of said fixed axial bearing during post angle fluctuations, and said apparatus arranged to be self supporting when placed within a vessel.

34. The apparatus of claim 1, further comprising, a means for the fluctuation of distance between said motor platform point and said fulcrum point.

35. An apparatus for deconglomeration and particle size reduction of solids in a liquid vehicle, such as for processing soils to be classified in a liquid vehicle, comprising, said motor mount weldment said motor mount weldment further forming a Vierendeel frame, a basket assembly, said basket assembly optionally containing classified media, a shaft assembly, a motor, a thrust bearing, a fixed axial bearing, a radial bearing gap formed between said thrust bearing and said fixed axial bearing, an axial bearing gap, said apparatus configured to support said shaft assembly with fluid dynamic bearing films resulting from the flow of solids in a liquid vehicle through said radial bearing gap and through said axial bearing gap, and said apparatus arranged to be self supporting when placed within a vessel.

36. The apparatus of claim 35, further comprising, an arrangement wherein the flow of solids in a liquid vehicle through said radial bearing gap and said axial bearing gap further acts to reduce the particle size of the solids or to classify soils to be classified.

37. An apparatus for deconglomeration and particle size reduction of solids within a liquid vehicle while minimizing complexity, use of wearing parts, and process contamination comprising, a shaft assembly fitted to a fully articulated motor platform providing multiple degrees of freedom, two or more submerged bearing surfaces said apparatus configured for pumping process components and liquid vehicle therethrough, and said apparatus further configured for forming fluid dynamic bearing films as the main radial and axial supports for said submerged bearing surfaces, a motor mount weldment, and a flexible Vierendeel frame, said motor mount weldment further comprised of said flexible Vierendeel frame.

38. The apparatus according to claim 37, further comprising, an arrangement such that said apparatus is self supporting when placed within a vessel.

39. The apparatus according to claim 37, further comprising, a rotating radial bearing, a fixed radial bearing, a thrust bearing, a fixed axial bearing, a radial bearing gap, said radial bearing gap being formed between the outer diameter of said rotating radial bearing and the inner diameter of said fixed radial bearing, an axial bearing gap, said axial bearing gap being formed between said thrust bearing and said fixed axial bearing.

40. The apparatus according to claim 37, further comprising, a rotating radial bearing, a fixed radial bearing, a thrust bearing, a fixed axial bearing, a radial bearing gap, said radial bearing gap being formed between the outer diameter of said rotating radial bearing and the inner diameter of said fixed radial bearing, an axial bearing gap, said axial bearing gap being formed between said thrust bearing and said fixed axial bearing.

41. The apparatus according to claim 40 further, comprising, an arrangement such that said apparatus is self supporting when placed within a vessel.

* * * * *